US006812806B2

(12) United States Patent
Leikus et al.

(10) Patent No.: US 6,812,806 B2
(45) Date of Patent: Nov. 2, 2004

(54) HIGH POWER SWITCHABLE POWER COMBINER

(75) Inventors: Vincent Leikus, Hauppauge, NY (US); Chuck Bryant, Hauppauge, NY (US)

(73) Assignee: L-3 Communications, Hauppauge, NY (US)

( * ) Notice: Subject to any disclaimer, the term of this patent is extended or adjusted under 35 U.S.C. 154(b) by 116 days.

(21) Appl. No.: 10/342,520

(22) Filed: Jan. 15, 2003

(65) Prior Publication Data

US 2004/0135648 A1 Jul. 15, 2004

(51) Int. Cl.[7] ..... H01P 1/10
(52) U.S. Cl. ..... 333/105; 333/124
(58) Field of Search ..... 333/32, 101, 105, 333/124, 125, 127

(56) References Cited

U.S. PATENT DOCUMENTS 3,694,775 A 9/1972 Rogers ..... 333/7
4,697,056 A 9/1987 Hoffman ..... 200/153
4,908,588 A * 3/1990 Hoffman et al. ..... 333/105
5,767,755 A 6/1998 Kim et al. ..... 333/101
6,323,742 B1 * 11/2001 Ke ..... 333/127
6,587,014 B2 * 7/2003 Do et al. ..... 333/101

OTHER PUBLICATIONS

Pending U. S. application S/N 09/896,171, filed Jun. 29, 2001 for "Switchable RF Power Divider/Combine" by John R. Mruz et al.

Product specification for KSCSU4W4–3A from KMW, May 1998.

* cited by examiner

*Primary Examiner*—Robert Pascal
*Assistant Examiner*—Dean Takaoka
(74) *Attorney, Agent, or Firm*—Baker Botts L.L.P.

(57) ABSTRACT

A high power switchable power combiner includes a plurality of input ports and a plurality of matching elements. The matching elements are arranged to be used in combination when more than two of the input ports are connected. A thermally conductive dielectric member may be provided between the inner conductor of the combiner and the conductive housing thereof to provide a thermal path to dissipate heat from the center conductor.

7 Claims, 3 Drawing Sheets

HIGH POWER SWITCHABLE POWER COMBINER

BACKGROUND OF THE INVENTION

This invention relates to switchable power combiners and power dividers of the type described in prior application Ser. No. 09/896,171, filed Jun. 29, 2001, which is assigned to the same assignee as the present application. The specification of the prior application is incorporated herein by reference as if fully set forth herein.

The power divider/combiner described in the referenced and incorporated prior application is useable in connection with power amplifiers as described therein. It becomes desirable in some applications to provide increased power handling capacity for RF signals, particularly in power combining applications, wherein the device is arranged to combine the outputs of multiple power amplifiers. The present invention relates to improvements of the power divider/combiner described in the above application for purposes of handling higher average signal power.

While power dividers and combiners are substantially the same in construction, the present invention is most applicable in the case of a power combiner for applications wherein the signal outputs from high power amplifiers are combined, and accordingly in the combiner application higher signal handling power is required.

It is an object of the present invention to provide a high power switchable power combiner which has the capability of handling higher signal power levels.

SUMMARY OF THE INVENTION

In accordance with the invention there is provided a high power switchable power combiner. The combiner includes a first plurality of at least three input ports for receiving signals to be combined. There is provided a transmission line having a center conductor and connected to an output port for providing output combined signals. A first plurality of switching members is provided, one for each of the input ports. Each of the switching members is moveable between a first position connecting the center conductor and a corresponding one of the input ports and a second position wherein the center conductor is disconnected from the corresponding input port. At least two switchable matching elements are provided. Each of the switchable matching elements is moveable between a first position connected to the center conductor at a selected location on the center conductor and a second position disconnected from the center conductor. The configuration of the matching elements and the selected location on the center conductor is selected to cause a first of the matching elements when in the first position to provide an impedance match for the switchable power combiner, when two of the first plurality of switching members are in the first position, and to cause a combination of two or more of the matching elements in the first position to provide an impedance match for the switchable power combiner when three or more of the first plurality of switching elements are in the first position.

In accordance with the invention there is provided a high power switchable power combiner which includes a first plurality of at least two input ports for receiving signals to be combined. There is provided a transmission line having a center conductor arranged between first and second conductive housing members and connected to an output port for providing output combined signals. A first plurality of switching members is provided one for each of the input ports. Each of the switching members is moveable between a first position connecting a first end portion of the center conductor and a corresponding one of the input ports and a second position wherein the center conductor is disconnected from the corresponding input port. There is provided at least one switchable matching element which is moveable between a first position, connected to the center conductor at a selected location thereon with respect to the first end portion, and a second position, disconnected from the center conductor. At least one thermally conductive dielectric member is arranged between the center conductor and one of the conductive housing members in at least the region of the center conductor between the first end portion and the selected location. The thermally conductive dielectric member is mechanically compressed between the center conductor and the conductive housing member.

For a better understanding of the present invention, together with other and further objects, reference is made to the following description, taken in conjunction with the accompanying drawings, and its scope will be pointed out in the appended claims.

DESCRIPTION OF THE PREFERRED EMBODIMENT

Figure 1:
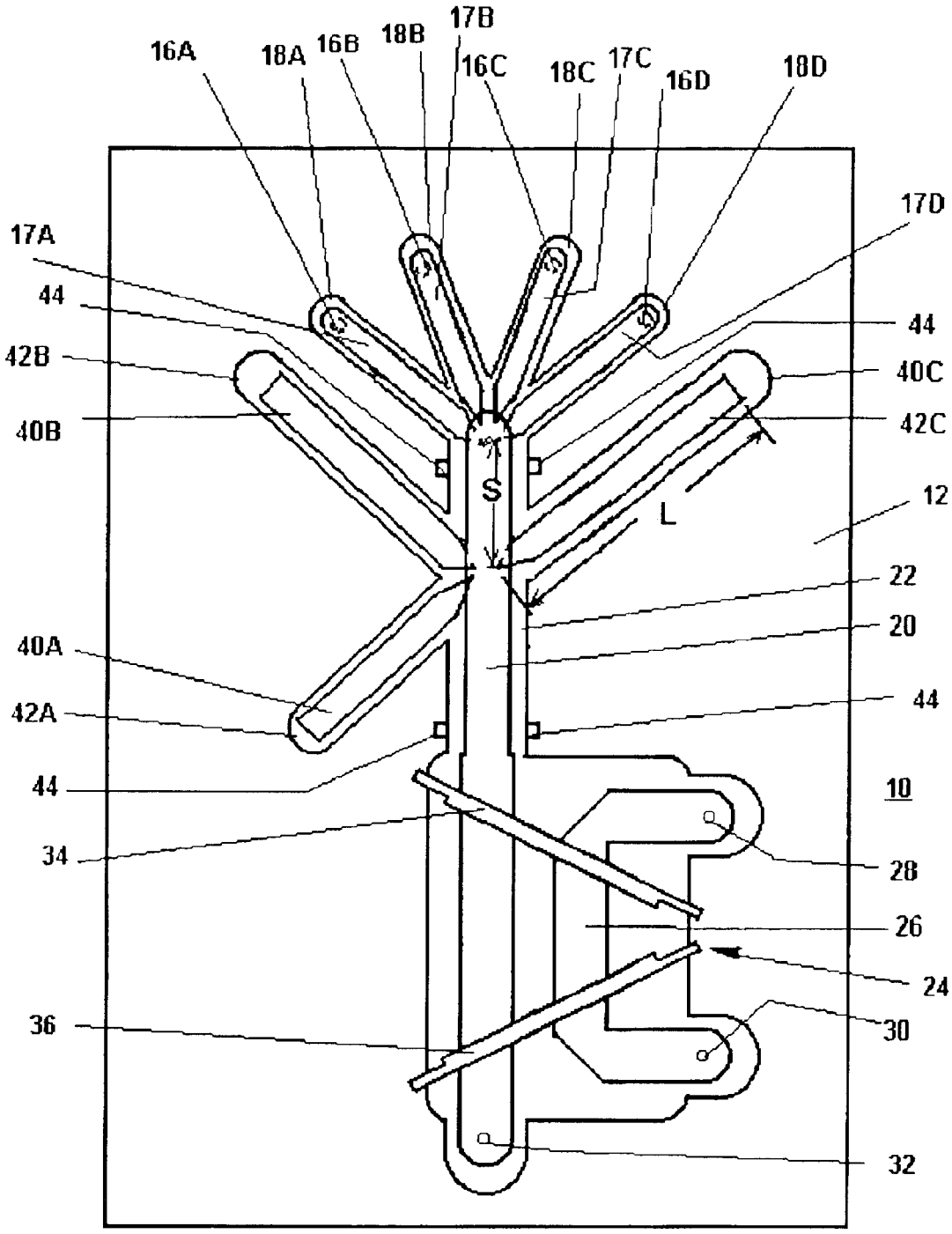
FIG. 1 is a top view of a power combiner according to a preferred embodiment of the present invention with the cover thereof removed and having the thermally conductive dielectric member removed.
Figure 2:
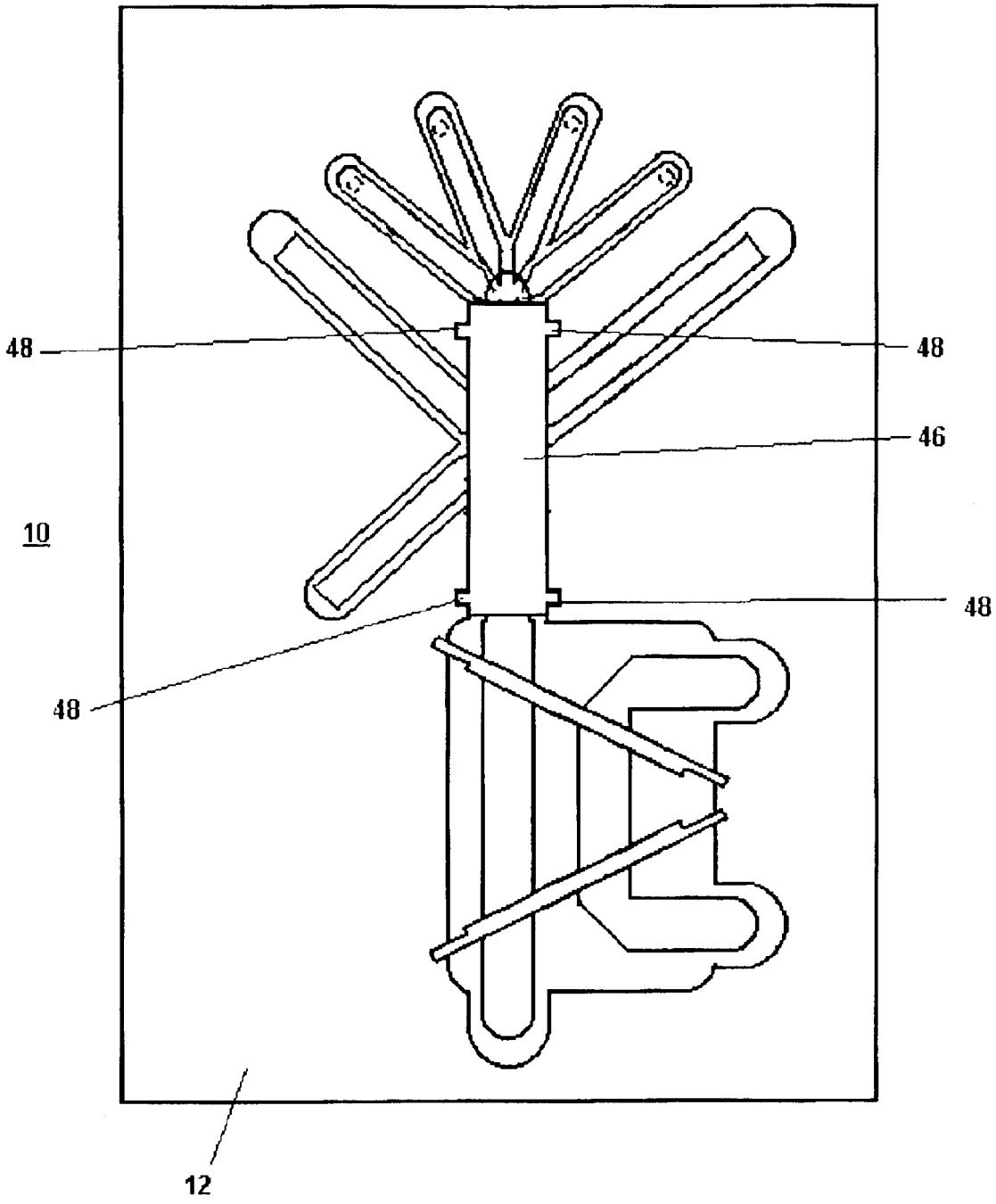
FIG. 2 is the power combiner of FIG. 1 with the thermally conductive dielectric member in place.
Figure 3:
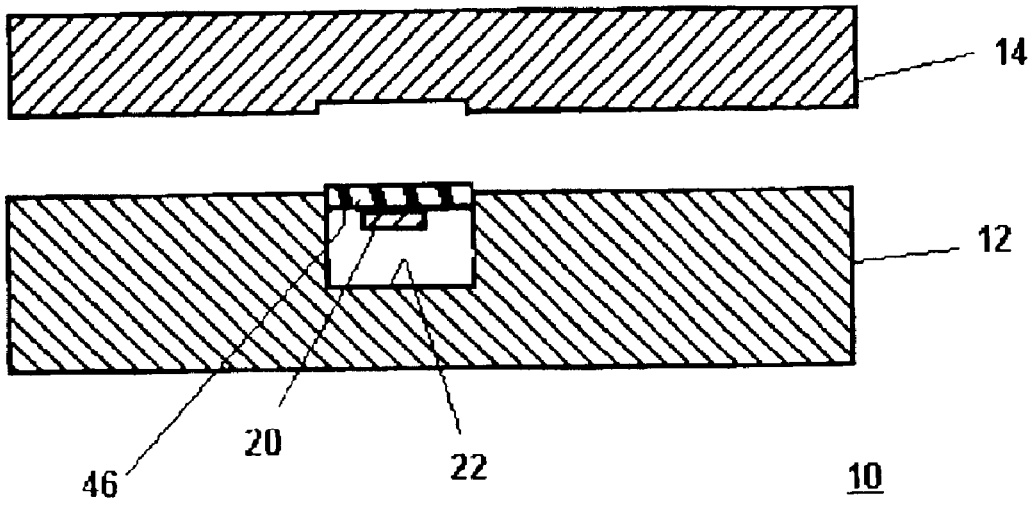
FIG. 3 is a partial cross sectional view of a portion of the power combiner shown in FIGS. 1 and 2.

Referring to FIGS. 1 through 3 there is illustrated a preferred embodiment 10 of a power combiner according to the present invention. The power combiner 10 is herein referred to as a "combiner," but those skilled in the art will recognize that the identical device can be used as a power divider as well as a power combiner.

The power combiner 10 includes a lower conductive housing member 12 and an upper conductive housing member 14 (see FIG. 3). The lower conductive housing member 12 includes grooves in an upper surface thereof forming channels in which center conductors of the power combiner are arranged. The particular arrangement of the power combiner 10 shown in the drawings includes four input ports 16A, 16B, 16C and 16D. Those familiar with the art will recognize that a larger or smaller number of input ports may be provided. In the drawing the input ports 16 are configured as the center conductors of a coaxial output connection arrangement on the top housing member 14, and are shown as dotted circles. Associated with each of the input ports 16 is a switching member 17 which is arranged to selectively interconnect the center conductor 16 of each input port with the center conductor 20 at a first end portion thereof. Center conductor 20 is connected to output port 32. Each of the switching members 17 comprises a flat conductive member arranged in a groove 18 and moveable within the groove in the direction into and out of the housing member 12 of FIG. 1 to connect the respective ports 16 to the center conductor 20 is in a first (upward) position and to have a second (lower) position wherein the respective input port 16 is disconnected from the center conductor 20. As shown in FIG. 1, the end of the switching members 17 remote from input ports 16 are tapered so that they intersect the center conductor 20 in approximately the same location at the first end portion.

The power combiner 10 illustrated in FIG. 1 includes a monitor coupler 24, which comprises an inner conductor 26, arranged next to inner conductor 20 and monitor ports 28 and 30 for monitoring forward and reverse power. Both inner conductor 20 and conductor 26 are supported in the groove of lower housing member 12 with insulating support members 34, 36, which are preferrably formed of thermally conductive dielectric material and received in notches formed in housing member 12. Additional support members may be used to support center conductor 20 within groove 22.

The power combiner 10 of FIGS. 1 through 3 includes first, second and third switchable matching elements which comprise center conductors 40A, 40B and 40C, which are arranged within corresponding grooves 42A, 42B and 42C. Matching elements 42 are moveable between a first position wherein one end of the matching elements is connected to center conductor 20 at a selected location thereon with respect to the first end wherein the center conductor contacts the switching elements 17.

In accordance with the switching power divider/combiner described in the referenced prior application, the switchable matching elements 40 provide an impedance match according to the number of switching elements connected to the center conductor for any particular desired connection arrangement. As described therein no matching elements are used when only a single input port is connected to the center conductor; a first matching element is connected to the second conductor, and the second and third matching elements are disconnected when two switching elements are connected thereto; a second matching element is connected to the center conductor and the first and third matching elements are disconnected when three switching elements are connected thereto; and a third matching element is connected to the center conductor and the first and second matching elements are disconnected when four switching elements are connected thereto. Accordingly, each matching element, as described in the prior application, is used alone at any particular time to provide the correct impedance match according to the number of switching elements that are connected. The inventors of the present invention have discovered that the use of only one matching element to provide an impedance match when multiple switching elements are connected to the center conductor can cause increased RF current in the center conductor and in the matching element in the region of the center conductor, which can lead to failure of the device, in particular overheating of the center conductor and the connection between the matching element and the center conductor.

According to the present invention, when more than two of the switching elements 17 are connected to the center conductor 20, more than one of the matching elements 40 is also connected to the center conductor 20. Accordingly, the matching elements 40 are not designed to individually compensate for the actual connection made in the case of more than two switching elements being connected, but are arranged to operate in combination to provide an impedance match. The instance where three or more of the switching elements 17 are connected is the instance when the combiner of the present invention is subjected to the greatest stress caused by high RF power being conducted.

In accordance with the present invention, when only one of the switching elements 17 is moved to the first position to interconnect center conductor 20 with an input port 16, none of the matching elements 40A, 40B or 40C is moved to the first position connected to center conductor 20.

When two of the switching elements 17 are moved to the first position to interconnect center conductor 20 to their respective input ports 16, matching element 40A is moved to the first position while matching elements 40B and 40C are in the second position. Accordingly, matching element 40A is at a selected location on center conductor 20 with respect to the first end at which switching members 17 contact and has a length selected to provide an impedance match between the center conductor as measured at the output port 32 and the two connected input ports 16.

When three of the switching elements 17 are moved to the first position to interconnect center conductor 20 with their respective input ports 16, impedance matching is provided by a combination of the impedance matching properties of matching element 40A and matching element 40B, both of which are moved to the first position connected to center conductor 20, while matching element 40C remains in the second position disconnected from center conductor 20. In this arrangement, since three input ports 16 are providing signal power to center conductor 20 there is a greater current in the center conductor 20 and a more significant impedance mismatch at the switching elements, which must be compensated by the reactive impedance presented by matching elements 40A and 40B. In contrast to the switchable power divider/combiner described in the referenced prior application wherein only one matching element is connected to the center conductor at a time, the present invention uses a combination of two or more matching elements for the condition wherein three or more switching elements are connected, so that the currents on the matching elements and their junction with the center conductor 20, are divided between two matching elements, thereby reducing the thermal heating stress on the matching elements and on the connection between the matching elements 40 and center conductor 20.

In the condition wherein all four of the switching elements 17 are moved to the first position to interconnect the center conductor and their respective input ports 16, all three matching elements 40A, 40B and 40C are moved to the first position connected to center conductor 20. In this condition, wherein the highest signal power level applied to the power combiner is experienced, for example, wherein it is combining the output of four power amplifiers, the currents required for impedance matching the junction are the greatest but these currents are divided among three matching elements 40A, 40B and 40C which are designed, by selection of their location on center conductor 20 and their length to work together to provide an impedance match for the junction.

In one example of the high power combiner according to the invention for operation at frequencies of 869 to 894 MHz. the following lengths L of the matching elements and spacings S are appropriate:

| Element | length L | spacing S |
|---|---|---|
| 40 A | 1.140" | 0.875" |
| 40 B | 1.504" | 0.733" |
| 40 C | 1.640" | 0.645" |

An additional feature included in the preferred embodiment of the present invention is the provision of a high thermal conductivity insulating material arranged between one of the conductive housing members 12, 14 and the center conductor 20 of the power combiner. The drawing of FIG. 1 shows the power combiner conductor arrangement without the high thermal conductivity dielectric part 46, which is shown in position in FIG. 2. The thermally conductive dielectric part may be made of Florinol, for example. Part 46 has tabs 48 arranged at four places around the periphery thereof which fit into recesses 44 in the conductive housing member 12. As shown in FIG. 3 thermally conductive dielectric member 46 fits between center conductor 20 and upper housing conductor 14 within groove 22 containing center conductor 20 and a smaller groove in upper housing conductor 14. In a preferred arrangement, the tolerances for the groove 20 and members that locate center conductor 20 are provided such that dielectric member 46 is compressed between conductive housing member 14 and center conductor 20, thereby to ensure good thermal contact between dielectric member 46 and center conductor 20 and providing a thermally conductive path for flow of excess heat energy out of center conductor 20. Preferably, the members are arranged to provide a compression of about 0.005 inches.

As shown in FIG. 1, the width of center conductor 20 can be varied to a smaller width and the depth of groove 22 may be changed to maintain the desired impedance of the transmission line formed by center conductor 20 and the upper and lower conductive housing members 12 and 14. For example for a 50 ohm line impedance center conductor may be 0.028" thick by 0.222" wide and be arranged in a groove 0.440" wide and 0.0234" high. For high power operation the center conductor is preferrably made of Beryllium Copper 17200 TM06 or TM08, plated with copper flash, sulfamate nickel and gold.

While there have been described what is believed to be the preferred embodiment of the invention, those skilled in the art will recognize that other and further changes and modifications may be made thereto without departing from the spirit of the invention and it is intended to claim all such changes and modifications as fall within the true scope of the invention.

We claim:

1. A high power switchable power combiner, comprising:

a first plurality of at least three input ports for receiving signals to be combined;

a transmission line having a center conductor and connected to an output port for providing output combined signals;

a first plurality of switching members, one for each of said input ports, each of said switching members being moveable between a first position connecting said center conductor and a corresponding one of said input ports and a second position wherein said center conductor is disconnected from said corresponding input ports; and at least two switchable matching elements, each of said switchable matching elements being moveable between a first position, connected to said center conductor at a selected location thereon, and a second position, disconnected from said center conductor, wherein the configuration of said matching elements and the selected location thereof on said center conductor is selected to cause a first of said matching elements, when in said first position, to provide an impedance match for said switchable power combiner when two of said first plurality of switching members are in said first position, and to cause a combination of two or more of said matching elements, when said two or more elements are in said first position, to provide an impedance match for said switchable power combiner when three or more of said first plurality of switching elements are in said first position.

2. A high power switchable power combiner as specified in claim 1 wherein there are provided four of said input ports and said switching elements and three of said switchable matching elements.

3. A high power switchable power combiner as specified in claim 2 wherein said switchable matching elements are arranged to provide an impedance match of said power combiner by having three of said switchable matching elements in said first position when four of said switching elements are in said first position.

4. A high power switchable power combiner as specified in claim 1 wherein said center conductor is arranged between first and second conductive housing members, and wherein there is further provided a thermally conductive dielectric spacer between said center conductor and one of said housing members.

5. A high power switchable power combiner, comprising:

a first plurality of at least two input ports for receiving signals to be combined;

a transmission line having a center conductor arranged between first and second conductive housing members and connected to an output port for providing output combined signals;

a first plurality of switching members, one for each of said input ports, each of said switching members being moveable between a first position connecting a first end portion of said center conductor and a corresponding one of said input ports and a second position wherein said center conductor is disconnected from said corresponding input ports;

at least one switchable matching element each switchable matching element being moveable between a first position connected to said center conductor at a selected location thereon with respect to said first end portion and a second position disconnected from said center conductor; and at least one thermally conductive dielectric member arranged between said center conductor and one of said conductive housing members in at least the region of said center conductor between said first end and said selected location, said thermally conductive dielectric member being mechanically compressed between said center conductor and said one conductive housing member.

6. A high power switchable power combiner as specified in claim 5 further including spacer members arranged between said center conductor and the other of said conductive housing members, wherein said spacer members are fabricated from thermally conductive dielectric material.

7. A high power switchable power combiner as specified in claim 5 wherein there are four of said input ports and four of said switching elements.

* * * * *